United States Patent [19]

Papasideris

[11] 4,011,959

[45] Mar. 15, 1977

[54] BUCKET-POSITIONER CIRCUIT WITH "NO DETENT" OPERATION

[75] Inventor: Stamos I. Papasideris, Bristol, Ill.

[73] Assignee: Caterpillar Tractor Co., Peoria, Ill.

[22] Filed: Feb. 13, 1976

[21] Appl. No.: 657,982

[52] U.S. Cl. ..... 214/762; 335/205

[51] Int. Cl.[2] ..... E02F 5/14

[58] Field of Search ..... 214/140, 762, 763, 764; 37/DIG. 1; 335/205, 206, 207

[56] References Cited

UNITED STATES PATENTS

| | | | |
|---|---|---|---|
| 3,519,155 | 7/1970 | Jefferson et al. | 214/764 |
| 3,659,734 | 5/1972 | Fuzzell | 214/764 |
| 3,782,248 | 1/1974 | Fuzzell | 214/762 X |

*Primary Examiner*—L. J. Paperner
*Attorney, Agent, or Firm*—Phillips, Moore, Weissenberger, Lempio & Majestic

[57] ABSTRACT

In a loader vehicle having a bucket pivotally supported upon a lift frame, a tilt jack interconnected between the lift frame and bucket by tilt linkage and a detented control valve by which the tilt jack is operated, two proximity switches on the tilt jack cylinder and a magnet on the tilt jack rod. Momentary operation of one of the switches causes a relay to be energized, the relay latching itself until momentary operation of the other switch unlatches the relay. Power is supplied to the detent-disabling mechanism through the relay contacts to disengage the control valve from a detented position as the bucket reaches its load position and to maintain such disengagement during loading operations.

8 Claims, 2 Drawing Figures

BUCKET-POSITIONER CIRCUIT WITH "NO DETENT" OPERATION

BACKGROUND OF THE INVENTION

The present invention relates to a positioning device for bucket loaders and more particularly to an improved system utilizing an electrical switch and actuating means mounted upon the telescoping cylinder and rod members of the tilt jack to terminate operation of the tilt jack as the bucket is moved to a preferred position on the loader.

Typically, bucket loaders have a bucket pivotably supported by lift arms with hydraulically operated tilt jacks interconnected between the lift arms and the bucket by suitable tilt linkage, the operation of the tilt jacks being controlled by a manually operable hydraulic valve having two operating positions. Movement by the operator of the valve to one of its operating positions will cause the tilt jacks to pivot the bucket upwardly to a rack-back position, while movement of the valve to its other operating position will cause the tilt jacks to pivot the bucket in the opposite direction, downwardly to dump position. Movement of the valve from its operating position to a non-operating position will stop tilting movement of the bucket by the tilt jacks and will hold the bucket at the position to which it has been moved by the tilt jacks. When the bucket is other than in its load position, i.e., the position wherein the floor of the bucket is parallel to the ground, the bucket may be moved and positioned at load position by moving the control valve to the appropriate operating position so that the tilt jacks will pivot the bucket towards the load position and by releasing the valve when the bucket has reached load position.

Positioning of the bucket in load position can be done by manipulation of the control valve by the operator. However, it is much more desirable to provide a means for automatically positioning the bucket at the intermediate load position, since such position is relatively critical and the operator's view of the bucket is generally obstructed as the bucket is approaching ground level. Since the position of the bucket at any moment is a function of the degree of extension or retraction of the tilt jack, it is common to use such extension to actuate an automatic positioning control.

Bucket loaders of the type contemplated herein normally employ detented tilt control valves to hold the control handle for the valve in rack-back or dump position when moved thereto so that the operator can release the control handle after the valve has been moved to its desired operating condition and the valve will stay in that position. Sufficient force by the operator on the control handle will enable him to pull the valve from its detent held position. It is desirable to provide means for rendering the detent mechanism inoperative as the handle is moved rapidly back and forth between rack-back and dump positions during a fishtailing loading operation to facilitate operator control over the bucket during loading.

Various types of position-control systems for bucket loaders have been proposed. Typically, such controls are hydraulically, mechanically, electrically or electronically controlled.

Hydraulic positioning systems suffer from control problems when malfunctions occur in the hydraulic system. For example, a leak in the slave cylinder or in the hydraulic circuits can cause bucket drifting ranging from slight movement to drifting simulating a slow dump. A broken supply line almost completely incapacitates the positioning control system. External repairs are time-consuming, particularly if the line to the tank has to be replaced. If an internal repair or adjustment has to be made in the hydraulic system, it is generally necessary to drain the hydraulic tank, which causes excessive down-time.

Electrical positioning systems overcome most of the above problems inherent in hydraulic systems, in that they are more reliable, more readily serviced, and are external and thus independent of the main hydraulic apparatus. However, most electrical positioning systems utilize microswitch means mechanically coupled to cams, recessed rods, etc., attached to the positioning hydraulic cylinder to indicate the position of the bucket. See, for instance, U.S. Pat. No. 3,420,393. Thus, such a combination is subject to wear, dirt, vibration, etc., common to earthmoving apparatus, with the associated maintenance and breakdown problems.

An improved approach is disclosed in U.S. Pat. No. 3,519,155, wherein a proximity switch is mounted on the tilt jack cylinder to be actuated by a magnet mounted on the tilt jack rod, the switch controlling directly a solenoid in the detent disabling mechanism. This approach reduces considerably the fouling of the system by dirt and debris. By use of a sufficiently long magnet this approach also allowed the detent mechanism to be inoperative during loading operations. However, this approach requires the proximity switch to handle the full solenoid current and requires the use of a relatively expensive, long magnet to maintain the switch closed during loading operations.

A further approach is that disclosed in U.S. Pat. No. 3,782,248 wherein two proximity switches are mounted on the tilt jack cylinder and a single small magnet is mounted on the tilt jack rod. Sequential and momentary actuation of the switches by movement of the magnet past the switches in the proper direction causes signals to be fed to an electronic logic circuit which then it turn causes the bucket to be positioned in load position while allowing "detent" action to be inoperative during a loading operation. Although this approach does not require the proximity switches to handle large currents and eliminates the substantial cost of a long magnet, the cost of the electronic logic circuit is relatively high.

SUMMARY OF THE INVENTION

It is an object of the present invention to provide a bucket-positioning system utilizing a pair of proximity switches on the tilt jack cylinder and a small magnet on the tilt jack rod and a control system actuated by sequential operation of the switches as the magnet moves therepast in the appropriate direction, wherein the switches carry a relatively small amount of current and wherein the control system utilizes a simple, inexpensive relay to complete the power circuit to the solenoid of the detent-disabling mechanism. The relay is operated in the control circuit to automatically position the bucket at load position and to cause the detent mechanism to be disabled during a loading operation.

BRIEF DESCRIPTION OF THE DRAWINGS

In the drawings forming a part of this application, and in which like parts are designated by like reference numerals throughout the same.

DESCRIPTION OF THE PREFERRED EMBODIMENT

Figure 1:
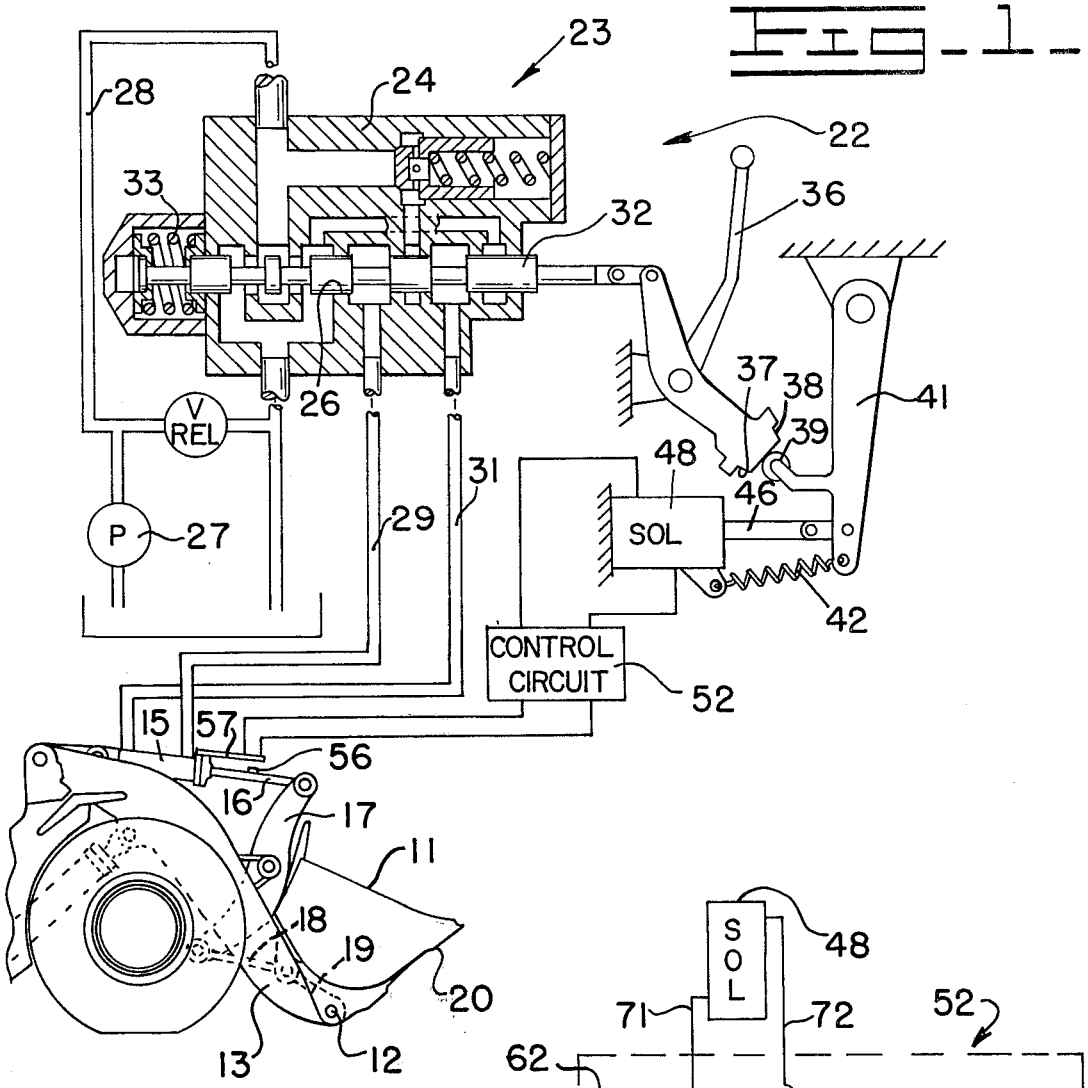
FIG. 1 illustrates the front end of a bucket loader vehicle, together with a schematic view of the hydraulic system for operation of the bucket and of the control system for positioning the bucket.
Figure 2:
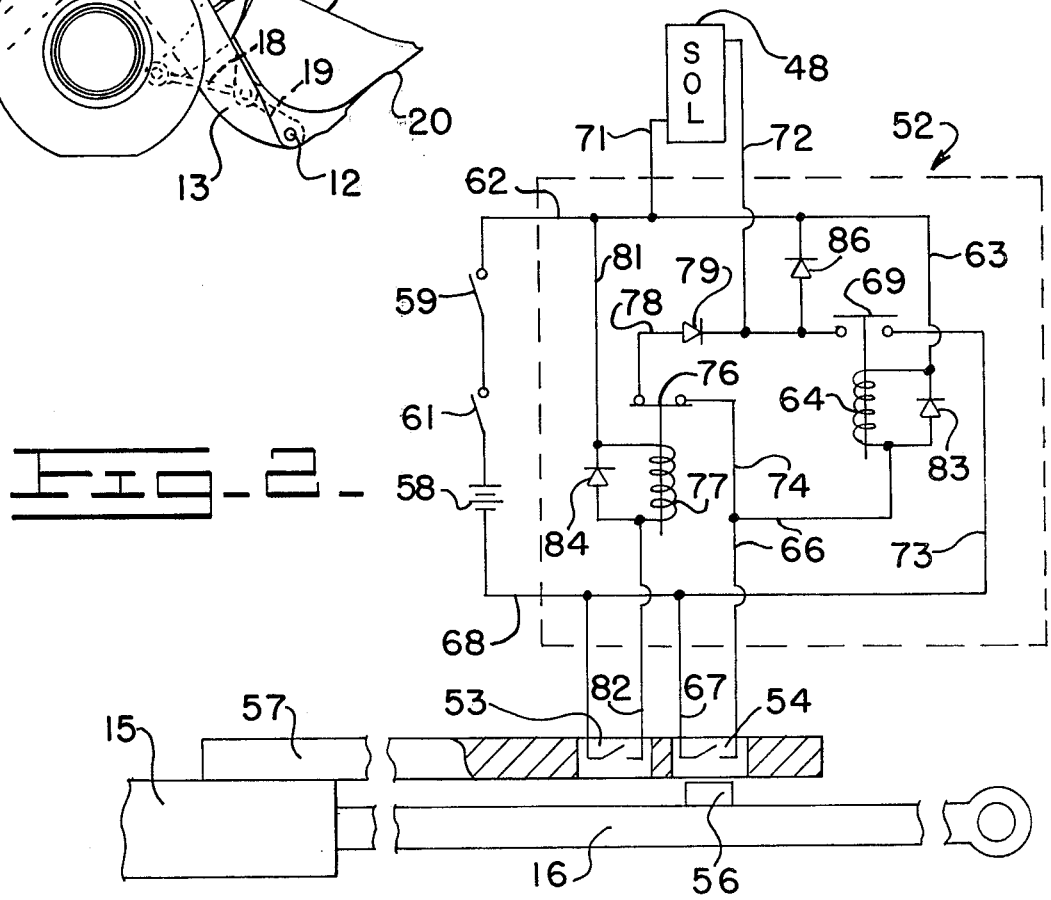
FIG. 2 is a schematic diagram of the electrical components utilized in the bucket-positioning control of FIG. 1.

Referring now to the drawings, wherein is illustrated a preferred embodiment of the invention, a bucket loader vehicle 10 has a bucket 11 pivotally supported at 12 upon a pair of lift arms, one of which is shown at 13. A tilt jack having a cylinder 15 and extendible rod 16 is interconnected between each of the lift arms 13 and bucket 11 by means of a tilt linkage which includes a Z-bar 17 and links 18 and 19. Full extension of rod 16 causes bucket 11 to pivot to its illustrated rack-back position. Partial retraction of rod 16 will pivot the bucket to its intermediate load position, wherein the bucket floor 20 will be parallel to the ground. Full retraction of rod 16 will pivot the bucket to its dump position, with the bucket floor sloping downwardly.

A tilt control system 22 for operating the tilt jack 15 includes a tilt control valve 23 which comprises a housing 24 defining a bore 26 in communication with a fluid pump 27 and the rod head ends of tilt cylinder 15 by means of conduits 28, 29 and 31 respectively. Spool 32 is reciprocally disposed in the valve bore 26 for regulating fluid flow in the pump conduit 28 to the hydraulic tilt jack, and is biased by centering spring 33 to the illustrated closed position wherein the fluid flow to or from the ends of the tilt jack cylinder 15 through conduits 29 and 31 is prevented. Spool 32 is connected to control lever 34 for movement upon actuation of manually operable handle 36. The control lever 34 is shown in a hold position, indicated at H, which corresponds to the spring-centered position of the spool.

Bucket 11 may be moved from its illustrated rack-back position to a dump position by moving handle 36 to dump position D. Spool 32 will be shifted to the right to communicate fluid from pump conduit 28 through conduit 31 to the rod end of cylinder 15 while fluid from the head end of the cylinder will exhaust through conduit 29. From a dump position, the bucket may be brought back up by moving handle 36 to rack-back position R which moves spool 32 to the left to reverse the fluid connections to the tilt cylinder. Movement of the bucket may be stopped at any time, as for example when it has moved back to the intermediate load position, by moving handle 36 to hold position H, either manually or by centering spring 33. In the hold position, fluid will be trapped in both ends of cylinder 15 so that the piston cannot move.

To permit detent latching of the control valve in either its rack-back or dump position, the end of the control lever 34 opposite its connection with spool 32 defines detent notches 37 and 38. Roller 39 is supported by arm 41 and is urged leftwardly by spring 42. If the control lever 34 is moved in either direction, to R or H positions, spring 42 will pull roller 39 into one of the detent notches and thereby prevent the control lever and spool 32 from returning to a centered position under the influence of spring 33. When so held, the operator may release the handle and the handle will remain in that position. At any time the operator may manually override the detent arrangement by applying sufficient force to the handle 36 to overcome the bias of spring 42 and cam the roller 39 out the detent which it is in.

The above-described detent arrangement can also be disabled by plunger 46 of solenoid 48. When solenoid 48 is de-energized, plunger 46 is free to move sufficiently to the left under the influence of spring 42 so that normal detent operation will result if handle 46 is moved to the extreme R or D positions. If solenoid 48 is de-energized, it will force plunger 48 to the right and hold it against the bias of spring 42 so that the detent action will be released or disabled.

Solenoid 48 is energized by control circuit 52 which responds to the actuation of switches 53 and 54 by actuating means 56. To simplify the control and to prevent it from being fouled by dirt or debris, switches 53 and 54 are preferably of the proximity type while the actuating means 56 is a permanent magnet which is effective to actuate the switches when brought into proximate relation thereto. Switches 53 and 54 are mounted on arm 57 secured to tilt jack cylinder 15 while magnet 56 is mounted on rod 16 fo movement therewith. Control circuit 52 is powered from vehicle battery 58 through normally open pressure switch 59 and normally open master switch 61 which controls the complete electrical circuits for the loader vehicle 10. The pressure switch 59 remains closed during operation of the vehicle 10 but automatically functions to remove power from the control circuit 52 in the event the vehicle is shut down.

In operation, let it be assumed that the tilt jack rod 16 has been extended to a position wherein magnet 56 is positioned adjacent switch 54, and that the switches 59 and 61 are now closed to supply power to the control circuit 52. Normally open switch 54 will be closed by magnet 56, so that current can flow from the positive line 62 through line 63, relay coil 64, line 66, switch 54 and line 67 to the negative line 68. Energization of relay 64 causes its normally open contacts 69 to close, allowing current to flow from positive line 62, line 71, solenoid 48, line 72, now-closed contacts 69 and line 73 to negative line 68. Control handle 36 may now be moved to rack-back position R, but roller 39 will not be pulled into detent notch 37 by spring 42 since solenoid 48 is now energized so that plunger 46 will hold roller 39 out of the detent.

With control handle 36 held by the operator in rack-back position, tilt jack rod 16 will extend, moving magnet 56 away from switch 54 so that it again opens. Relay 64 will remain energized, however, since a holding circuit is provided therefor through line 74, normally closed contacts 76 of relay 77, line 78, diode 79, now-closed contacts 69 of relay 64 and line 73 to the negative line 68. Diode 79 blocks current flow through the holding circuit from solenoid 48 while allowing holding current for relay coil 64 to flow therethrough. Thus, when proximity switch 54 is first closed diode 79 will prevent solenoid 48 from being energized through switch 54. This allows switch 54 to handle only the relatively small current through relay coil 64, while the relatively large current flow through the solenoid 48 flows only through relay contacts 69.

When the bucket 11 reaches full rack-back position, or an intermediate rack-back position, the operator may release handle 36, allowing spring 33 to move handle 36 an spool 32 to centered positions and causing the bucket to be held at the position it has reached.

The handle 36 can now be moved to and held by the operator in dump position D. Valve 23 will reverse the connections to tilt jack 15 and the tilt jack rod will begin to retract to pivot the bucket downwardly. Since the solenoid 48 is still energized, the detent action will still be disabled. In due course, magnet 56 will pass by switch 54 and cause it to close. Nothing happens in response to this switch closure, since this merely completes a circuit parallel to the holding circuit for relay 64. Further retraction of rod 16 moves magnet 56 past switch 54 (which then opens) and into proximity to switch 53, causing that switch to close. An energizing circuit is thus completed from positive line 62, through line 81, relay 77, line 82, switch 53 and line 83 to negative line 68. Energization of relay 77 causes its normally closed contacts 76 to open and open the holding circuit for relay 64. Relay contacts 69 restore to normally open position and break the energizing path for solenoid 48. Solenoid plunger 46 is now free for leftward movement, allowing roller 39 to be pulled into detent 38 by spring 42, so that handle 36 may be released by the operator.

Continued retraction of tilt jack rod 16 will move magnet 56 past switch 53 so that the switch will open and de-energize relay 77, and restore its contacts 76 to their normally closed position. Relay 64 remains de-energized since its contacts 69 are open and switch 54 is open, and solenoid 48 remains de-energized.

After dumping, the operator will wish to return the bucket to load position, and does so by moving handle 36 to rack-back position R and by then releasing the handle. Solenoid 48 is still de-energized and the detent action of roller 39 will hold the handle in R position. Extension of tilt jack rod 16 pivots bucket 11 upwardly from dump position and moves magnet 56 towards switch 53. When the magnet moves into proximity with the switch, the switch will close. Relay 77 is again energized, but nothing occurs in response thereto since the contacts 76 merely open an already open circuit. Further movement of magnet 56 allows switch 53 to open, relay 77 to de-energize and relay contacts 76 to restore to closed position. Further movement of magnet 56 brings it into proximity with switch 54, which closes to energize relay 64 and, in turn, solenoid 48. With solenoid 48 now energized, plunger 46 and lever 41 are forced to the right against the bias of spring 42. With roller 39 moved from detent 37, centering spring 33 will move spool 32 and handle 36 to hold position H. With switch 54 properly positioned relative to cylinder 15 and magnet 56 properly positioned on rod 16 the bucket 11 will thus automatically stop at the load position when moved thereto from dump position, with the floor of the bucket being level with the ground.

Solenoid 48 will not be de-energized and the detent action will not be restored until such time thereafter as the bucket is moved in the opposite direction, past hold position and towards dump position. Accordingly, the described arrangement will allow the operator to fishtail the bucket to facilitate loading without interferences from the rack-back detent apparatus. Fishtailing is the operation wherein the bucket is rocked back and forth by the repetitious movement of the control handle from the rack-back to the dump position. Fishtailing is unhindered by the present bucket-positioner since bucket movement is normally limited between the loading position and full rack-back position during the fishtail operation. Since solenoid 48 is always energized in this mode, roller 39 is always held away from detent notches 37 and 38 at such time.

Diodes 83, 84 and 86 are connected across relay coils 64, 77 and solenoid 48 to protect against transients and arcing of contacts when the coils and solenoid are de-energized.

I claim:

1. A bucket-positioner for a loader vehicle having a bucket pivotably supported on a lift frame and a hydraulic tilt jack having telescoping cylinder and rod members for pivoting said bucket to and between rack-back and dump positions upon telescoping movement of said tilt jack members, a hydraulic valve operatively associated with said tilt jack, said valve having first and second positions for causing said tilt jack to move said bucket towards said rack-back and dump positions, respectively, and a third position for holding said tilt jack against operation, means biasing said valve to its third position, detent means for holding said valve in its first or second position, when moved thereto, and means including an electrically energizable solenoid for disabling said detent means when said solenoid is in one of its states of energization or de-energization the improvement comprising:

a. a magnet mounted on one of said tilt jack members, b. a pair of proximity switches mounted on the other of said tilt jack members for sequential actuation by said magnet upon telescoping movement of said tilt jack members in either direction, at least one of said switches having normally open switch contacts, c. a relay having a relay coil and contacts actuated by said relay coil when energized, d. a source of electrical energy, e. circuit means for connecting said relay coil to said source for energization of said relay upon actuation of said one proximity switch by said magnet, f. holding circuit means for maintaining the connection of said relay coil, when energized, to said source through normally open contacts of said relay, g. circuit means for connecting said solenoid to said source in response to said relay being in one of its states of energization of de-energization, h. means actuable in response to a proximate position of said magnet to the other of said switches for breaking said holding circuit means.

2. A bucket-positioner as set forth in claim 1, wherein said solenoid is connectible to said source through said normally open relay contacts.

3. A bucket-positioner as set forth in claim 2 and further including a diode in said holding circuit for blocking current flow from said solenoid through a portion of said holding circuit while allowing holding current for said relay coil to flow therethrough.

4. A loader as set forth in claim 2 wherein said one proximity switch is connected in series with said relay coil and said source.

5. A bucket-positioner as set forth in claim 1 wherein said other proximity switch has normally open contacts and said means (h) includes a second relay having a coil connectible to said source upon closure of said normally open contacts of said other proximity switch, said second relay having normally closed contacts connected in said holding circuit for flow of holding current therethrough.

6. A bucket-positioner as set forth in claim 5, wherein said solenoid is connectible to said source through said normally open contacts of said first relay.

7. A bucket-positioner as set forth in claim 6 and further including a diode in said holding circuit for blocking current flow from said solenoid through a portion of said holding circuit while allowing holding current for the relay coil of said first relay to flow therethrough.

8. A bucket-positioner as set forth in claim 7 wherein said one proximity switch is connected in series with the relay coil of said first relay and said other proximity switch is connected in series with the relay coil of said second relay.

* * * * *